US005181249A

United States Patent [19]

Schiller

[11] Patent Number: 5,181,249

[45] Date of Patent: Jan. 19, 1993

[54] THREE CHANNEL AUDIO TRANSMISSION AND/OR REPRODUCTION SYSTEMS

[75] Inventor: Richard F. Schiller, Basingstoke, England

[73] Assignee: Sony Broadcast and Communications Ltd., Basingstoke, England

[21] Appl. No.: 692,992

[22] Filed: Apr. 29, 1991

[30] Foreign Application Priority Data

May 30, 1990 [GB] United Kingdom ..... 9012024

[51] Int. Cl.[5] ..... H04R 5/00

[52] U.S. Cl. ..... 381/27; 381/2; 381/3; 381/4; 381/19

[58] Field of Search ..... 381/27, 2, 3, 4, 19

[56] References Cited

U.S. PATENT DOCUMENTS 3,280,258 10/1966 Curtis ..... 381/27
4,516,257 5/1985 Torick ..... 381/27
4,980,915 12/1990 Ishikawa ..... 381/27

OTHER PUBLICATIONS

RCA Technical Notes Three Channel FM Band Stereo System Francis Raymond Holt, Nov., 1959.

*Primary Examiner*—Jin F. Ng
*Assistant Examiner*—Edward Lefkowitz
*Attorney, Agent, or Firm*—Alvin Sinderbrand; William S. Frommer

[57] ABSTRACT

In order to permit three-component (left, right and back) audio signals (LS, RS, BS) to be conveyed by a three-channel (left, right and mono) transmission system and still permit stereo and mono compatibility, the signals are encoded so that the three channels carry LS−½BS, RS−½BS and LS+RS+BS, respectively. Upon receipt, the signals can be decoded back to LS, RS and BS respectively. In a mono receiver without such a decoder, the signal LS+RS+BS on the mono channel is employed, and in a stereo receiver the signals LS−½BS and RS−½BS on the stereo channels are employed.

14 Claims, 2 Drawing Sheets

THREE CHANNEL AUDIO TRANSMISSION AND/OR REPRODUCTION SYSTEMS

BACKGROUND OF THE INVENTION

1. Field of the Invention

This invention relates to three-channel (stereo plus mono) audio signal transmission or conveyance systems and to three-component (stereo plus back) sound reproduction systems.

2. Description of the Prior Art

There are several known systems which convey, on three channels (LC, RC, MC), left and right stereo signals (LS,RS) and a mono signal (MS=LS+RS), such as terrestrial television systems with "NICAM"728 stereo and frequency modulated (FM) mono, and "Video 8" systems with pulse code modulated (PCM) stereo and FM mono. There is also known a system of sound reproduction using three sources which produce left and right stereo signals (LS,RS) and a background or "back" signal (BS), these signals subsequently being used to reproduce left and right stereo sounds and a back sound.

The present invention is concerned with reproducing three-component stereo/back signals conveyed using a three channel stereo/mono system. A simple way of doing this would be to convey the left and right stereo signal components (LS,RS) on the left and right stereo channels (LC,RC), respectively, and to convey the back signal component (BS) on the mono channel (MC). However, this presents a problem that mono compatibility is lost, because a mono receiver would receive merely the back signal (BS), whereas for satisfactory mono reproduction the reproduced mono signal should primarily be the sum of the left and right signals (LS+RS).

OBJECTS AND SUMMARY OF THE INVENTION

An object of the present invention is to provide an improved three-channel audio signal transmission and/or conveying system.

Another object of the present invention is to provide a system for reproducing three-component stereo/back signals conveyed using a three channel stereo/mono system without loss of mono compatibility.

A further object of the present invention is to provide a three-channel audio signal processing system with a minimum of circuit complexity.

According to one aspect of the present invention, the above problem is overcome and the above objects are achieved by conveying:

(i) on the mono channel (MC) a composite mono signal (MS') formed by an addition of the left and right stereo signals (LS,RS) and the back signal (BS), for example in generally equal proportions (MS'=LS+RS+BS);

(ii) on the left channel (LC) a composite left signal (LS') formed by a difference between the left signal (LS) and the back signal (BS), for example with the back signal generally half-weighted (LS'=LS−½BS); and (iii) on the right channel (RC) a composite right signal (RS') formed by a difference between the right signal (RS) and the back signal (BS), again for example with the back signal generally half-weighted (RS'=RS−½BS).

According to another aspect of the invention, there is provided an encoder for encoding a three component signal comprising left and right stereo signals (LS,RS) and a back signal (BS) for conveyance on a three-channel system, having left and right stereo channels (LC,RC) and a mono channel (MC), wherein the encoder is operable: to provide for the left stereo channel (LC) a composite left signal (LS') in which the left stereo signal (LS) and the back signal (BS) are weighted generally in the ratio 1:−½; to provide for the right stereo channel (RC) a composite right signal (RS') similarly formed from the right stereo signal (RS) and the back signal (BS); and to provide for the mono channel (MC) a composite mono signal (MS') in which the left and right stereo signals (LS,RS) and the back signal (BS) are generally equally weighted.

According to a further aspect of the present invention, there is provided a decoder for decoding composite left, right and mono signals (LS',RS',MS') received on left, right and mono channels (LC,RC,MC) of a three-channel signal conveying system to produce left and right stereo signals (LS,RS) and a back signal (BS), wherein the decoder is operable: to produce the left stereo signal (LS) by combining the composite left, mono and right signals (LS',MS',RS') with weightings generally of 3:1:−1, respectively; to produce the right stereo signal (RS) by combining the composite right, mono and left signals (RS',MS',LS') with weightings generally of 3:1:−1, and to produce the back signal (BS) by combining the composite mono, left and right signals (MS',LS',RS') with weightings generally of 2:−2:−2.

As will be appreciated from the following specific description of a preferred embodiment of the invention, the decoded left and right stereo signals and back signal can be formed so as to be equivalent to the originating left and right stereo signals and back signal. Further, a mono receiver on the mono channel (MC) will receive the composite mono signal (MS'=LS=RS+BS), which provides good mono reproduction.

Moreover, a stereo receiver on the left and right channels (LC,RC) will receive the signals (LS−½ BS) and (RS−½ BS), having the effect of stereo reproduction with the back component inverted and placed centre stage. This provides reasonable stereo reproduction, especially if the back signal (BS) is independent of the left and right stereo signals (LS,RS) because the listener would be unaware of the inversion.

The above, and other objects, features and advantages of this invention will be apparent from the following detailed description of illustrative embodiments which is to be read in connection with the accompanying drawings.

DESCRIPTION OF THE PREFERRED EMBODIMENTS

Figure 1:
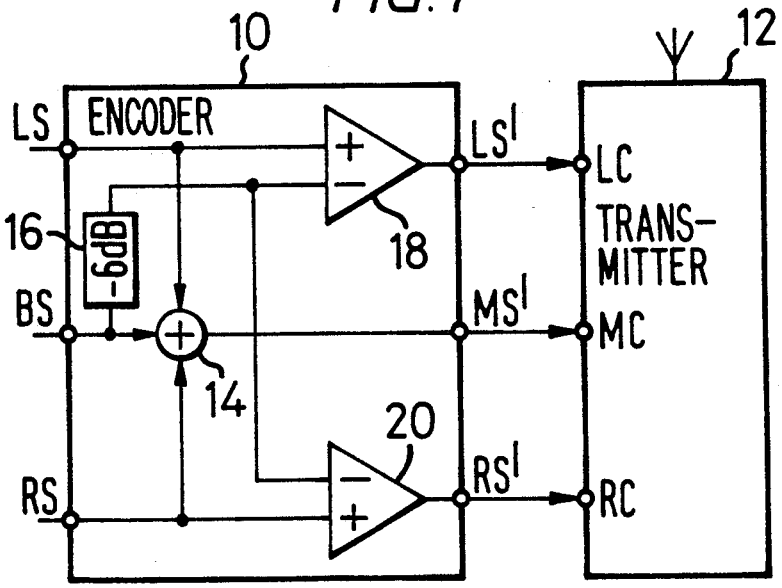
FIG. 1 is a circuit diagram of a three-channel encoder and transmitter embodying an aspect of the invention.

Referring to FIG. 1 of the drawings, an encoder 10 is supplied with left and right stereo signals LS,RS and a back signal BS, and is operable to encode these signals to provide composite left, right and mono signals LS',RS',MS' which are transmitted on three channels LC,RC,MC of a transmitter 12. The encoder 10 includes a summing amplifier 14 which sums all three input signals LS,RS,BS with equal weight to produce the composite mono signal MS'=LS+RS+BS for the mono channel MC. The encoder 10 also includes a −6dB attenuator 16 which receives the input back signal BS to produce a signal ½BS, which is supplied to the inverting inputs of two differencing amplifiers 18,20. The left input signal LS is supplied to the non-inverting input of the differencing amplifier 18, which thus produces an output signal LS−½ BS, which is provided as the composite left signal LS' for the left channel LC. Similarly, the right input signal RS is supplied to the non-inverting input of the differencing amplifier 20, which thus produces an output signal RS−½BS, which is provided as the composite right signal RS' for the right channel RC.

Figure 2:
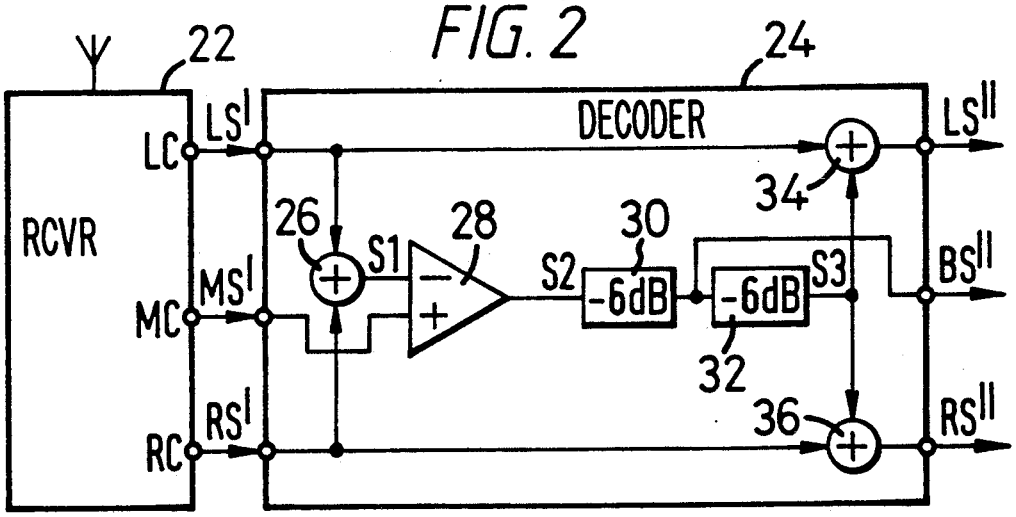
FIG. 2 is a circuit diagram of a three-channel receiver and decoder embodying another aspect of the invention.

Referring to FIG. 2, a three channel receiver 22 receives the signals from the transmitter 12 (FIG. 1), and respectively supplies the composite signals LS',RS',MS' on the three channels LC,RC,MC to a decoder 24. The decoder 24 includes a summing amplifier 26 which sums the composite left and right signals LS',RS' with equal weighting to produce a first intermediate signal S1, such that:

$$S1 = LS' + RS' \tag{1}$$

The first intermediate signal S1 and the composite mono signal MS' are supplied to the inverting and non-inverting inputs, respectively, of a differencing amplifier 28, which produces a second intermediate signal S2, such that:

$$S2 = MS' - S1 \tag{2}$$

From (1) & (2): $S2 = MS' - LS' - RS'$ (3)

The second intermediate signal S2 is supplied to a −6dB attenuator 30, which provides the output back signal BS'' from the decoder, such that:

$$BS'' = \tfrac{1}{2}\, S2 \tag{4}$$

From (3) & (4): $BS'' = \tfrac{1}{2}\,(MS' - LS' - RS')$ (5)

Bearing in mind that in the encoder in FIG. 1:

$$LS' = LS - \tfrac{1}{2}BS \tag{6}$$

$$RS' = RS - \tfrac{1}{2}BS \tag{7}$$

$$MS' = LS + RS + BS \tag{8}$$

it follows from (5) to (8) that:

$$BS'' = \tfrac{1}{2}(LS + RS + BS - LS + \tfrac{1}{2}BS - RS + \tfrac{1}{2}BS) = BS$$

Therefore the output back signal BS'' from the decoder 24 of FIG. 2 is equivalent to the input back signal BS to the encoder 10 of FIG. 1.

The decoder 24 also includes a −6dB attenuator 32 which receives the back signal BS'' (=BS) and provides a third intermediate signal S3, such that:

$$S3 = \tfrac{1}{2}BS'' \tag{9}$$

Furthermore the decoder includes: a summing amplifier 34 which sums the third intermediate signal S3 and the composite left signal LS' with equal weight to produce the output left stereo signal LS'' from the decoder; and similarly a summing amplifier 36 which sums the third intermediate signal S3 and the composite right signal RS' with equal weight to produce the output right stereo signal RS'' from the decoder. Accordingly:

$$LS'' = S3 + LS' \qquad RS'' = S3 + RS' \tag{10}$$

From (6), (7), (9) & (10)

$$LS'' = \tfrac{1}{2}BS + LS - \tfrac{1}{2}BS \qquad RS'' = \tfrac{1}{2}BS + RS - \tfrac{1}{2}BS$$
$$= LS \qquad\qquad = RS$$

Therefore, the output left and right stereo signals LS'',RS'' from the decoder 24 of FIG. 2 are equivalent to the input left and right stereo signals LS, RS, respectively, to the encoder 10 of FIG. 1.

Figure 3:
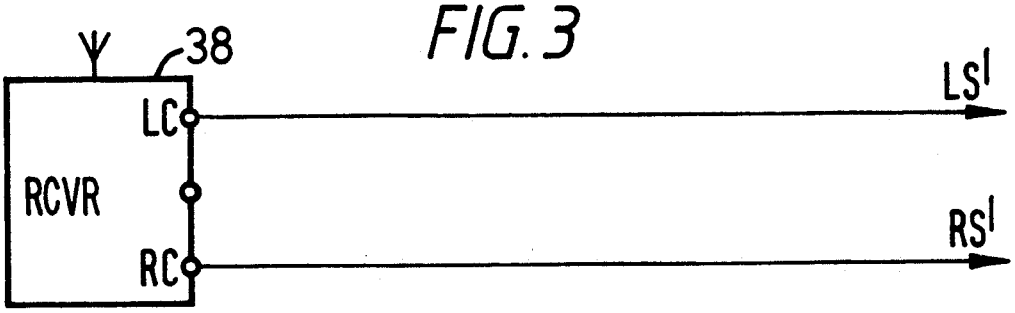
FIG. 3 is a schematic diagram of a stereo receiver when receiving signals from the transmitter shown in FIG. 1.

In the case where the three-channel signal transmitted by the transmitter of FIG. 1 is received by a compatible stereo receiver 38, as shown in FIG. 3, the receiver will output the composite left and right signals LS',RS' on the left and right channels LC,RC. From equations (6) and (7) above it will be appreciated that these signals LS',RS' are equivalent to LS−½BS and RS−½BS which will provide stereo reproduction with the back signal appearing inverted and centre stage.

Figure 4:
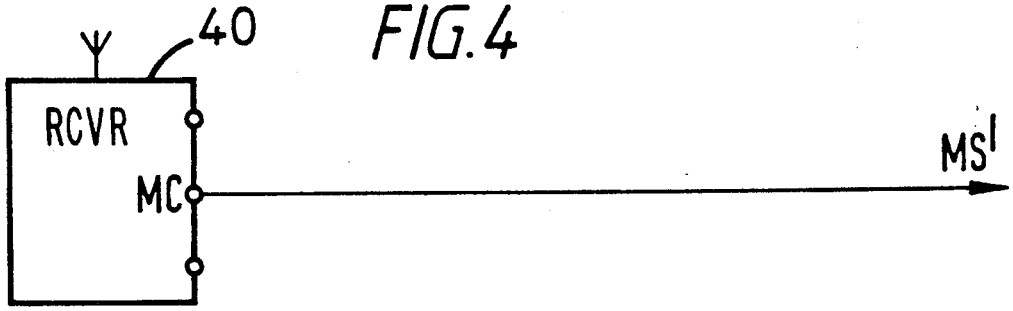
FIG. 4 is a schematic diagram of a mono receiver when receiving signals from the transmitter shown in FIG. 1.

In the case where the three-channel transmitted signal is received by a compatible mono receiver 40, as shown in FIG. 4, the receiver will output the composite mono signal MS' on the mono channel MC. From equation (8) above, it can be seen that this signal MS' is equivalent to LS+RS+BS, which will provide good mono reproduction.

Figure 5:
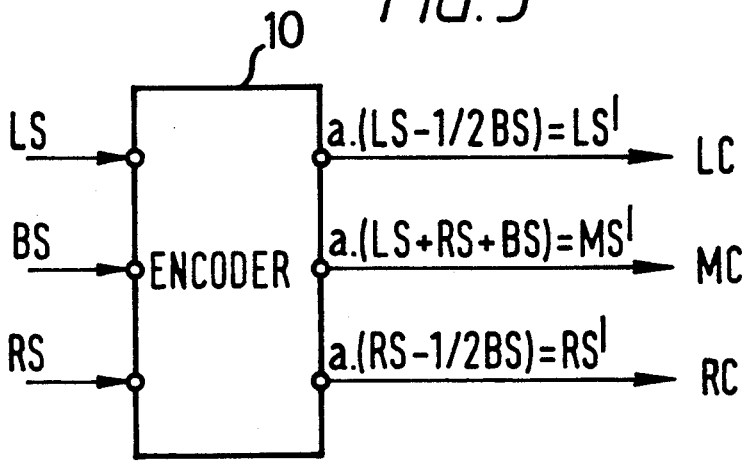
FIG. 5 is a schematic diagram of a three-channel encoder.
Figure 6:
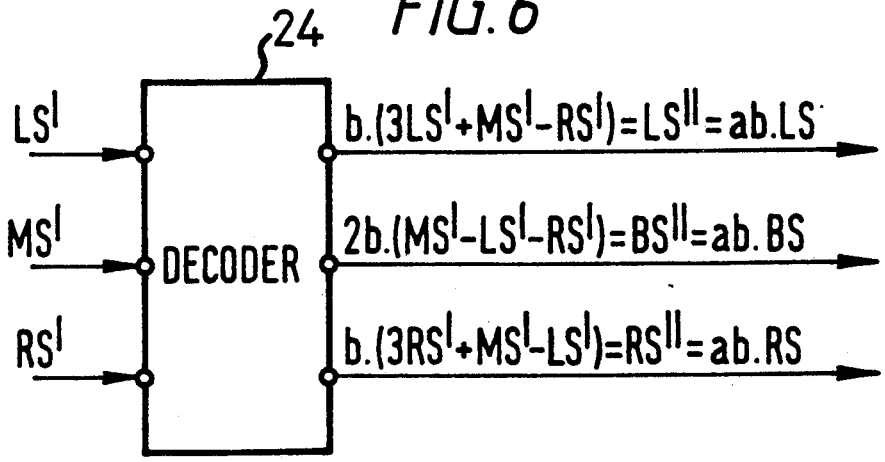
FIG. 6 is a schematic diagram of a three-channel decoder.

It will be appreciated that many modifications and developments may be made to the encoder and decoder described above. For example, although the arrangement of summing amplifier, attenuator and pair of differencing amplifiers shown in FIG. 1 provides a preferred form of encoder, in view of the simplicity of the circuitry, other arrangements are possible which provide the transfer functions, shown in FIG. 5, of:

$$LS' = a.(LS - \tfrac{1}{2}BS)$$

$$MS' = a.(LS + RS + BS)$$

$$RS' = a.(RS - \tfrac{1}{2}BS)$$

where "a" is an amplification constant. Furthermore, although the arrangement of summing amplifiers, differencing amplifier and attenuators shown in FIG. 2 is preferred, again in view of the simplicity of the circuitry, other arrangements are also possible which provide the transfer functions, shown in FIG. 6, of:

$$LS'' = b.(3LS' + MS' - RS')$$

$$BS'' = 2b.(MS' - LS' - RS')$$

$$RS'' = b.(3RS' + MS' - LS')$$

where "b" is an amplification constant.

The invention is applicable to any system which provides at least three separate audio channels, such as the above-mentioned "NICAM" 728 or other three-audio-channel television systems, or "Video 8" systems. For practical purposes, the signal-to-noise ratios of the three channels should preferably be of comparable magnitudes.

Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention as defined by the appended claims.

I claim:

1. In a method of transmitting an audio signal having a left stereo component, a right stereo component and a back component using a transmitting system having left, right and mono channels, the steps of:

forming a composite mono signal by adding said left stereo component, said right stereo component and said back component;

forming a composite left signal and a composite right signal from respective differences between said left stereo component and said back component, and between said right stereo component and said back component; and transmitting said composite mono signal, said composite left signal and said composite right signal over said mono, left and right channels, respectively.

2. A method according to claim 1, in which said left stereo component, said right stereo component and said back component have substantially equal weights when forming said composite mono signal.

3. A method according to claim 1, in which said back component has a weight which is approximately half that of said left stereo component and said right stereo component, respectively, when forming said composite left signal and said composite right signal.

4. A method according to claim 2, in which said back component has a weight which is approximately half that of said left stereo component and said right stereo component, respectively, when forming said composite left signal and said composite right signal.

5. An encoder for encoding a three-component signal having a left stereo component signal, a right stereo component signal and a back component signal for transmission by a three-channel system having a left stereo channel, a right stereo channel and a mono channel, said encoder comprising: first forming means for forming a composite left signal for said left stereo channel of said three-channel system from said left stereo component signal and said back component signal with a respective weight ratio of approximately $1:-\frac{1}{2}$; second forming means for forming a composite right signal for said right stereo channel of said three-channel system from said right stereo component signal and said back component signal with a respective weight ratio of approximately $1:-\frac{1}{2}$; and third forming means for forming a composite mono signal for said mono channel of said three-channel system from said left stereo component signal, said right stereo component signal and said back component signal with substantially equal weights.

6. An encoder according to claim 5, in which said third forming means includes adding means for adding said left stereo component signal, said right stereo component signal and said back component signal together so as to form said composite mono signal; and in which said first and second forming means respectively include first and second subtracting means for respectively subtracting the $\frac{1}{2}$ weighted back component signal from said left stereo component signal and said right stereo component signal so as to form said composite left signal and said composite right signal, respectively.

7. An encoder according to claim 6, wherein said adding means adds said left stereo component signal, said right stereo component signal and said back component signal with said substantially equal weights.

8. A decoder for decoding a composite left signal, a composite right signal and a composite mono signal respectively received on left, right and mono channels of a three-channel signal receiving system, said decoder comprising: means for producing a left stereo component signal by combining the composite left, mono and right signals with relative weightings of approximately $3:1:-1$, respectively; means for producing a right stereo component signal by combining the composite right, mono and left signals with relative weightings of approximately $3:1:-1$, respectively; and means for producing a back component signal by combining the composite mono, left and right signals with relative weightings of approximately $2:-2:-2$, respectively.

9. A decoder according to claim 8, in which said means for producing a back component signal includes first adding means for adding the composite left and right signals to produce a first intermediate signal, subtracting means for subtracting said first intermediate signal from said composite mono signal to produce a second intermediate signal, and first attenuating means for attenuating said second intermediate signal so as to form said back component signal; and in which said means for producing a left stereo component includes said first adding means, said subtracting means and said first attenuating means of said means for producing the back component signal and further includes second attenuating means for attenuating said back component signal from said first attenuating means to form a third intermediate signal, and second adding means for adding said composite left signal and said third intermediate signal so as to form said left stereo component signal; and in which said means for producing the right stereo component signal includes said first adding means, said subtracting means and said first attenuating means of said means for producing the back component signal and said second attenuating means of said means for producing the left stereo component and further includes third adding means for adding said composite right signal and said third intermediate signal so as to form said right stereo component signal.

10. A decoder according to claim 9, wherein each of said first, said second and said third adding means adds the respective signals supplied thereto with substantially equal weights.

11. A decoder according to claim 9, wherein said subtracting means subtracts said first intermediate signal from said composite mono signal with substantially equal weights.

12. A decoder according to claim 10, wherein said subtracting means subtracts said first intermediate signal from said composite mono signal with substantially equal weights.

13. A decoder according to claim 9, wherein each of said first and said second attenuating means attenuates the respective signal supplied thereto by a factor of one half.

14. A decoder according to claim 12, wherein each of said first and said second attenuating means attenuates the respective signal supplied thereto by a factor of one half.

* * * * * *